United States Patent [19]

Sutherland

[11] 3,972,637

[45] Aug. 3, 1976

[54] REVERSIBLE SELF-PROPELLED PLATE COMPACTOR

[76] Inventor: John W. Sutherland, P.O. Box 5050, Jacksonville, Fla. 32207

[22] Filed: July 31, 1975

[21] Appl. No.: 599,011

[52] U.S. Cl. ..... 404/133; 404/113

[51] Int. Cl.[2] ..... E01C 19/34

[58] Field of Search ..... 404/133, 113, 83

[56] References Cited

UNITED STATES PATENTS

| | | | |
|---|---|---|---|
| 3,001,458 | 9/1961 | Croucher | 404/133 |
| 3,314,341 | 4/1967 | Schulin | 404/133 X |
| 3,367,250 | 2/1968 | Ytterberg | 404/113 X |
| 3,416,417 | 12/1968 | McIlrath | 404/113 X |
| 3,775,019 | 11/1973 | Konig | 404/133 |
| 3,782,845 | 1/1974 | Briggs | 404/133 |
| 3,832,080 | 8/1974 | Stoecker | 404/133 |

*Primary Examiner*—Nile C. Byers

*Attorney, Agent, or Firm*—George H. Baldwin; Arthur G. Yeager

[57] ABSTRACT

A self-propelled vibratory plate compactor including a rotating eccentric weight and a motor for rotating the weight in a predetermined direction mounted together on a support which is mounted by means of a bearing with a vertical axis on a horizontal work-engaging compacting plate so as to be rotatable on the plate through 180°. The weight provides vibratory compacting and propulsion forces to the plate. The weight causes the plate to move in the direction in which the weight is rotating, and, by rotating the support through 180°, the direction in which the plate is propelled is reversed.

6 Claims, 9 Drawing Figures

REVERSIBLE SELF-PROPELLED PLATE COMPACTOR

Vibratory plate compactors for soil, paving materials and the like, comprising eccentric weights rotated on horizontal axes, and driven by motor means, such as by gasoline engines, are well known. The vibratory force imparted to the plate by the rotating weight provides both a compacting vertical movement of the plate and horizontal vibratory components of motion which cause the plate to move along the work in the direction toward which the weight rotates. Compactors of this or similar types are, for example, shown in U.S. Pat. Nos. 3,759,634 — Hundey et al; 3,782,845 — Briggs et al; and 3,314,341 — Schulin et al.

During operation of such compactors, the machine is often required to compact along a path up to a wall or curb, or to the end of a trench, and it may then be desired to operate back along the same path. Various machines have been developed which may be reversed to obviate the otherwise necessary turning of the machine end-for-end. U.S. Pat. No. 3,603,244 to Dresher shows a reversing transmission between the motor and two eccentric weights, U.S. Pat. No. 3,001,458 to Croucher describes a machine embodying two eccentric weights, one above the other, with means to shift the axis of the upper weight toward and away from one end of the compactor plate while shifting the axis of the lower weight in the respectively opposite direction, U.S. Pat. No. 3,832,080 to Stoecker discloses a machine with two eccentric weights with means to shift the synchronous phase position of one weight with respect to the other, and U.S. Pat. No. 3,283,677 to Uebel teaches the use of a reversible ground-engaged driving roller for propelling the machine.

It is an object of this invention to provide a simple, reliable, reversible self-propelled compactor, which is propelled by the action of the eccentric weight without the provision of a driven roller, which is readily reversible without complicated transmission mechanism, and which does not require two eccentric weights.

Reversible compactors have tended to be much more costly than non-reversible machines. It is a specific object of the invention to provide reversibility at very little additional cost and minimal complexity.

According to a specific embodiment of the invention, an eccentric weight is supported in bearings affixed to a support plate, a gasoline engine is resiliently supported on the plate and is provided with a belt to drive the eccentric weight, and the support plate is disposed above and fixed to one race member of a horizontally oriented vertical axis ball bearing, the other race being fixed to the upper surface of the compacting plate. The support plate may be swung about the bearing axis from a position in which the eccentric rotates toward one end of the compacting plate into a position in which it rotates toward the other end of the compacting plate and thus acts to propel the compacting plate in the corresponding opposite directions.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawing, in which:

Figure 1:
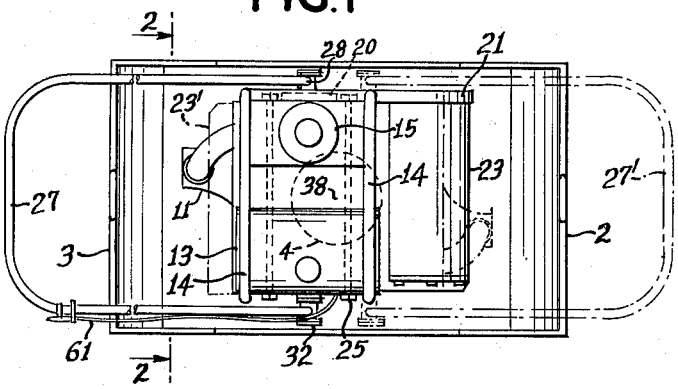
FIG. 1 is a top plan view of a compacting machine in accord with the invention, with full and broken lines respectively representing the positions of the motor, support plate and eccentric for propulsion in one and the opposite directions.
Figure 2:
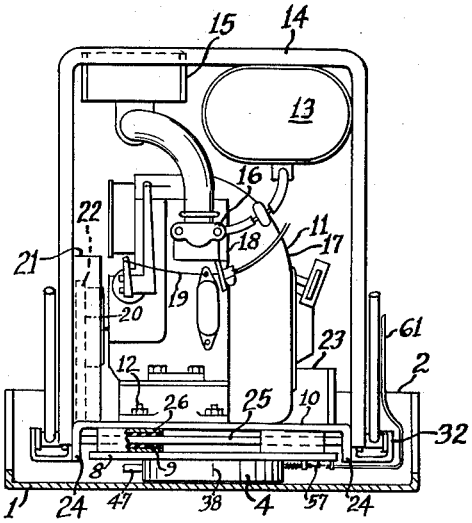
FIG. 2 is a sectional view of the machine taken along line 2—2 of FIG. 1.
Figure 3:
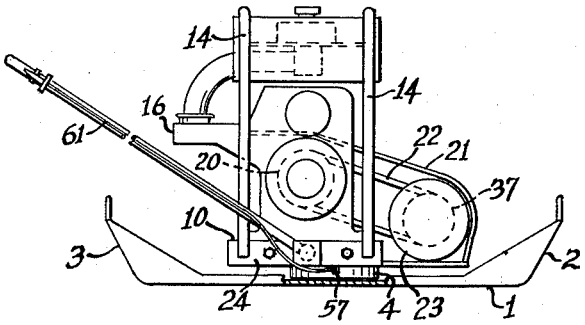
FIG. 3 is a side elevational view of the machine.
Figure 4:
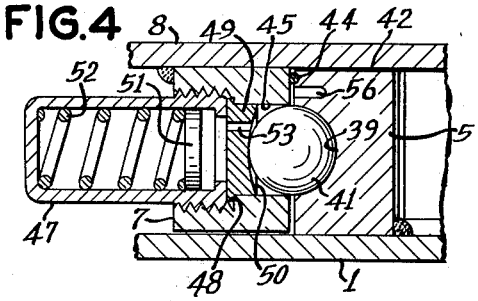
FIG. 4 is a sectional view on an enlarged scale showing details of a bearing portion of the machine.
Figure 7:
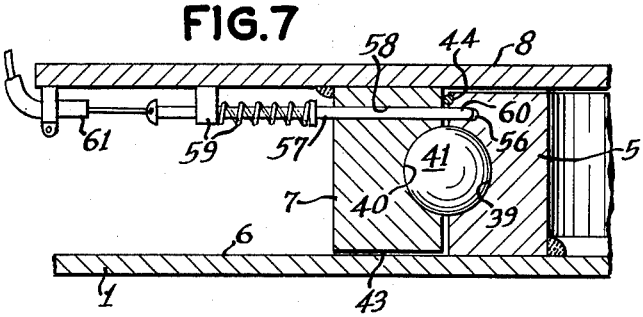
FIG. 7 is a view similar to and on the scale of FIG. 4 but showing details of another portion of the bearing of the machine.
Figure 5:
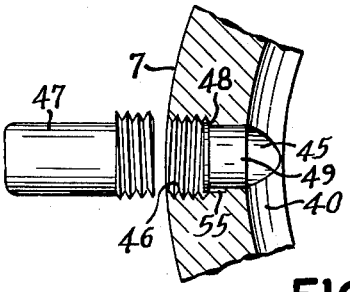
FIG. 5 is an exploded plan view partially in section and on a reduced scale showing details of portions of the elements shown in FIG. 4.

Referring to FIGS. 1 — 3, the compactor according to the invention comprises a horizontal work-engaging compactor plate 1 having upturned opposite ends 2 and 3 which moves along a path and vibrates vertically to compact the underlying earth or other material. A large diameter ball bearing 4 is provided which, as seen in FIGS. 4 and 7, comprises inner race member 5 welded to the upper surface 6 of plate 1 and an outer race member 7 welded to a vibratory base plate 8 rotatably to support the base plate on the compactor plate 1. Base plate 8 in turn supports through rubber bushings, such as bushing 9, a motor mounting plate 10 to which motor 11 is fixed by bolts 12. The motor 11 typically comprises a gasoline engine with a gasoline tank 13 strapped to roll bars 14 which are affixed to motor mounting plate 10, an air filter 15 connected to carburetor 16, a flywheel and recoil starter cover 17, a block 18, and a throttle control mechanism 19. A pulley 20 on the engine drive shaft is disposed under a cover 21 and by means of belt 22 drives the rotor of eccentric assembly 23.

Motor mounting plate 10 comprises downward side edge flanges, such as flange 24, and a pair of long supporting bolts, such as bolt 25, span between the flanges and through the rubber bushings 9. The bushings line the interiors of hollow cylindrical bosses, such as boss 26, which are welded to base plate 8. Thus the motor plate 10 and motor, or engine, are isolated from the vibratory base plate 8 by rubber bushings to reduce the transmission of vibrations from the base plate to the motor.

Figure 9:
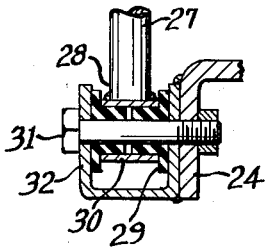
FIG. 9 is a sectional view on an enlarged scale taken along line 9—9 of FIG. 1.

An operator's handle 27 is pivotally mounted at its opposite ends, such as end 28, to the side flanges of motor plate 10 through rubber bushings, as best seen in FIG. 9. The handle is shown in position in FIGS. 1 and 3 for holding by an operator following the compactor, but it may be swung from this position forwardly so that the operator may walk in front of the moving compactor. Bushing 29, FIG. 9, which may be in two sections as shown, is housed in cylindrical member 30, which is welded to the end 28 of the handle, while a bolt 31 passes through the bushing, through the flange 24 and through an outer flange 32 weldedly affixed to the flange 24 to support the bushing. Bushing 29 provides additional vibration isolation for the handle.

Figure 8:
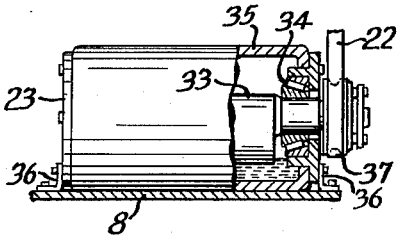
FIG. 8 is an elevational view on an enlarged scale and partially in section of an eccentric weight assembly shown in FIGS. 1 and 3.
Figure 6:
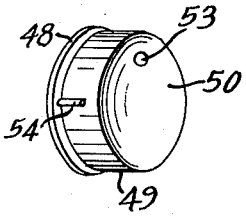
FIG. 6 is a perspective view on a further enlarged scale of a plug element shown in FIGS. 4 and 5.

Eccentric assembly 23, as best seen in FIG. 8, includes an eccentric weight 33 rotatable in bearings, such as bearing 34, and enclosed within a housing 35. The housing is rigidly mounted to base plate 8, such as by bolts and lugs 36, so as to impart vibrations thereto when the eccentric is rotated by means of driven pulley 37 on which the motor-driven belt 22 is entrained. Lubricating oil is desirably contained within housing 35 for lubricating the motor bearings 34.

With the compactor as shown in full lines in FIG. 1 and in FIG. 3, the compactor will move under the influence of the rotating eccentric, which is driven in a clockwise direction by the motor, from left to right, with end 2 of plate being the leading end. When end 2 meets an obstacle, or when for any other reason it is desired to reverse the direction in which the machine is to progress, the base plate 8, together with motor mounting plate 10, is swung through 180° about the vertical axis, represented at 38, of bearing 4, from the position shown in full lines in FIG. 1 into the position there shown in broken lines. Moreover, should it be desired to drive the plate 1 to the side, the support plate may be rotated 90° rather than 180°, taking precaution, however, during sideway driving movement to prevent the plate from digging into the ground, since it is not normally desirable to curve plate 1 upwardly at the sides, and further taking precaution to prevent tipping of the machine which may be somewhat off-balance under these conditions.

Details of the bearing arrangement are shown in FIGS. 4 – 7. The heavy inner and outer race members 5 and 7 are provided with races 39 and 40 which have depths substantially equal to the radius of a ball 41 and which together substantially completely surround the balls. Thus there is, desirably, minimal clearance between the race members. It is further desired that there be minimal clearance between the upper surface 42 of race member 5 and plate 8, and minimal clearance between the lower surface 43 of outer race member 7 and the upper surface 6 of compactor plate 1. An O-ring 44 is nested in and encircles race member 5 and engages race member 7 to restrict the outflow of grease from the races and the entrance of dust particles thereinto.

The machine is assembled by bringing race member 7, welded to support plate 8, down into position around race member 5 and by thereafter loading the bearing races with balls 41. A bore 45 having a diameter to pass a ball extends through race member 7. The outer portion 46 of the bore 45 is enlarged and screw threaded to receive a hollow cap assembly 47 and to provide a shoulder at the inner end of the enlarged portion 46 against which the outer rim or flange portion 48 of a plug 49 may seat. With cap and plug removed, balls 41 may be introduced one by one into the races through bore 45. When the races are completely filled, plug 49 is inserted and advanced into the bore until its rim 48 seats on the shoulder at the inner end of enlarged portion 46, thereby to precisely position the spherically arcuate inner end surface 50 of the plug. The cap 47 is now screwed in to hold the plug in position. The end face 50 of the plug is spherically arcuate having a radius of curvature of the arc as nearly as possible identical to the radius of the circle at which an imaginary horizontal plane would intersect along the bottom, i.e. the deepest part, of the race 40 of member 7. When in position in bore 45, the plug surface will thus complete the circle formed around the bearing by such intersection of the bottom of race 40 by such plane, and a ball 41 rolling along the race in contact with its deepest part will roll with its circular path unbroken as it rolls across the surface 50 of the plug.

The cap 47 includes an internal piston 51 backed by a compression spring 52 and plug 49 includes a small opening 53 therethrough, an opening which opens through face 50 above (or below) the track of a ball thereacross. A rib 54 formed on plug 49 cooperates with a groove 55 in bore 45 to prevent seating of the plug, or rotation of the plug into, a position in which opening 53 would be in the path of balls 41. Grease is filled into bore portion 46 and into cap 47 against the piston 51 before screwing in the cap, so that when cap 47 is screwed in, grease is under pressure against plug 49 and is accordingly urged by spring 52 into the ball races through opening 53.

The inner race member 5 is provided with at least two pin-receiving apertures 56 opening toward member 7, that is, opening horizontally and radially outwardly with respect to the vertical bearing axis, with such apertures disposed 180° apart around member 5. A locking pin 57 extends through a bore 58 in member 7 which aligns in one rotative position, corresponding to the full line position of FIG. 1, with one of such apertures 56 and, in the 180° displaced position, corresponding to that shown in broken lines in FIG. 1, with the other of such apertures 56. The pin 57 is carried by and beneath support plate 8 by means 59 which urge end portion 60 of the pin to engage in either of apertures 56 when it comes into alignment therewith. Coaxial cable control means 61, including portions arranged on handle 27, are provided for retracting pin 57 from an aperture 56 when it is desired to rotate plate 8 to reverse the direction of travel of the compactor.

As shown in the drawings, the cap 47 and pin 57 are on diametrically opposite sides of race member 7, so that one aperture 56 is seen in FIG. 4 while the oppositely placed aperture 56 is seen in FIG. 7. It will be understood, however, that it is not necessary that 180° separate pin 57 from cap 47.

Should it be desired, more than two apertures 56 may be provided to permit locking of the plate 8 in positions other than the two positions in which propulsion is toward end 2 or toward end 3.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A vibratory plate compactor comprising a horizontal work-engaging plate, an eccentric weight, vibratory base means supporting said weight for rotation on a horizontal axis, motor means carried by said base for rotating said weight, and bearing means interposed between and supporting said base means in vibration transferring relation above said horizontal plate for rotation with respect thereto about a vertical axis generally centrally of said plate.

2. The combination according to claim 1, and selective means for locking said base means in either of two rotative positions about said axis displaced by 180°.

3. The combination according to claim 1 wherein said bearing means comprises a ball bearing.

4. The combination according to claim 2 wherein said ball bearing comprises horizontal inner and outer races, one of which is affixed to the top surface of said plate and the other of which is affixed in underlying relation to said base means.

5. The combination according to claim 1 wherein said base means comprises a plate member, said eccentric weight being mounted in bearings and said bearings being rigidly fixed to said plate member, said motor means comprises an engine, and resilient mounting means are interposed between said engine and said plate member.

6. A vibratory plate compactor comprising an eccentric weight rotatable on a horizontal axis in bearings, said bearings being fixed to a support member, driving means mounted on said support member for rotating said weight in a predetermined direction, a generally horizontal work-engaging plate having opposite ends, a vibration transmitting vertical axis bearing assembly mounting said support member on said base plate for rotation through 180° between two positions in each of which said horizontal axis extends laterally of said base plate and in one of which positions said weight rotates toward one of said ends and in the other of which said weight rotates toward the other of said ends, said eccentric weight being operative to jump said compactor along in the direction in which said weight is rotating while providing downward work-compacting blows to such work.

* * * * *